United States Patent [19]

Marker et al.

[11] Patent Number: 4,665,852

[45] Date of Patent: May 19, 1987

[54] DEVICE FOR SECURING A FORKED BOOM TO THE MAST OF A SAILBOARD

[75] Inventors: Hannes Marker, Alpspitzstr. 37, 8100 Garmisch-Partenkirchen; Karl Janich, Forstinning; Otto Hüss, Wallgau, all of Fed. Rep. of Germany

[73] Assignee: Hannes Marker, Garmisch-Partenkirchen, Fed. Rep. of Germany

[21] Appl. No.: 795,359

[22] PCT Filed: Feb. 21, 1985

[86] PCT No.: PCT/EP85/00059

§ 371 Date: Oct. 22, 1985

§ 102(e) Date: Oct. 22, 1985

[87] PCT Pub. No.: WO85/03681

PCT Pub. Date: Aug. 29, 1985

[30] Foreign Application Priority Data

Feb. 23, 1984 [DE] Fed. Rep. of Germany ..... 3406610

[51] Int. Cl.[4] ..... B63H 9/10

[52] U.S. Cl. ..... 114/98; 114/99

[58] Field of Search ..... 114/39.2, 89–94, 114/97–99

[56] References Cited

U.S. PATENT DOCUMENTS 4,448,142 5/1984 Pollard ..... 114/99

FOREIGN PATENT DOCUMENTS 2941134 4/1981 Fed. Rep. of Germany ..... 114/97
3030495 3/1982 Fed. Rep. of Germany ..... 114/98
3032631 4/1982 Fed. Rep. of Germany ..... 114/39.2
3046470 7/1982 Fed. Rep. of Germany ..... 114/39.2
3100624 8/1982 Fed. Rep. of Germany ..... 114/98
2105280 3/1983 United Kingdom ..... 114/39.2

*Primary Examiner*—Galen L. Barefoot
*Assistant Examiner*—Stephen P. Avila
*Attorney, Agent, or Firm*—Fleit, Jacobson, Cohn & Price

[57] ABSTRACT

A device for securing a forked boom to a mast and includes clamping elements, which engage the mast and are provided on a retaining member which at least partly surrounds the mast. The retaining member is annular and is larger in diameter than the mast. At least one wedge-shaped clamping element is slidably mounted in the annular space between the retaining member and the mast.

18 Claims, 5 Drawing Figures

DEVICE FOR SECURING A FORKED BOOM TO THE MAST OF A SAILBOARD

Figure 1:
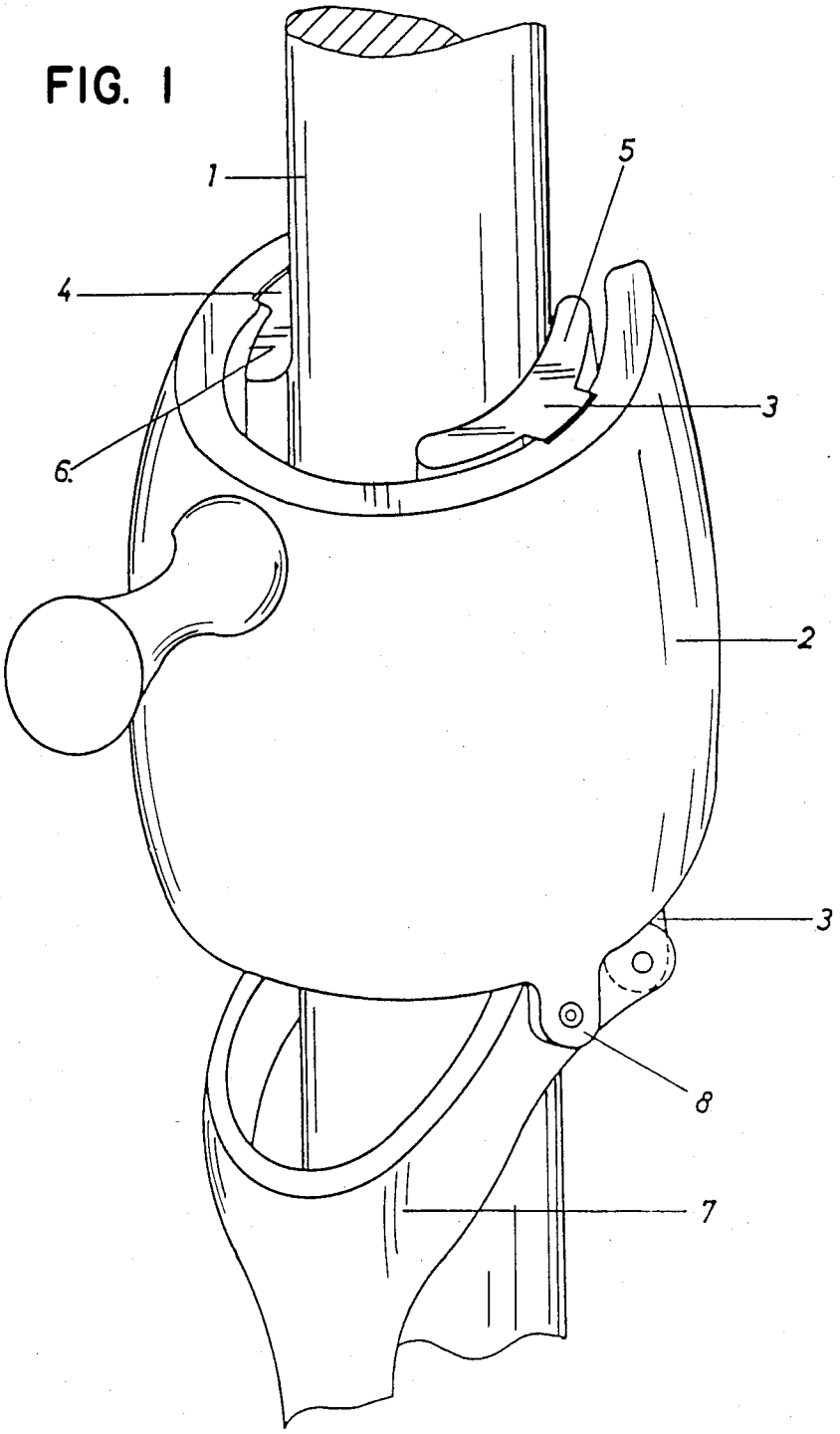

This invention relates to a device for securing a forked boom to a mast. The device includes clamping elements which engage the mast and are provided on a retaining member which at least party surrounds the mast.

A device of that kind, which is known from German Utility Model Specifications 78 01 634, comprises two double-armed levers, which are pivoted to retaining members, which are connected to the U-shaped fitting that is mounted on the forked boom. Clamping jaws adapted to be forced against the mast are carried by said levers at one end thereof, and an eccentric tightener for exerting the clamping force engages said levers at their other ends.

A fixing device known from German Utility Model 79 34 981 comprises a cuff, which is adapted to be clamped to the mast by a clamp screw, or clamping jaws, which embrace the mast like tongs and are adapted to be forced against each other by an eccentric toggle.

In a device which is of the kind described first hereinbefore and is known from prior Patent Application P 31 30 838.4, which is no prior publication, clamping jaws are connected to the U-shaped retaining member by means of parallel links and engage opposite sides of the mast and are adapated to be locked in their clamping position when they have been tightened by means which are similar to a toggle joint.

It is an object of the invention to provide a device which is simple and can easily be actuated and by which the formed boom can be reliably clamped to the mast.

In a device of the kind described first hereinbefore that object is accomplished in accordance with the invention in that the retaining member is annular and is larger in diameter than the mast and that at least one wedge-shaped clamping element is slidably mounted in the annular space between the retaining member and the mast. In the device in accordance with the invention of the retaining member virtually constitutes a supporting cuff, which is firmly clamped against the mast by the wedge-shaped clamping element.

The wedge-shaped clamping elements may be axially slidable relative to the mast. They may consist of two claimping wedges, which engage opposite sides of the mast. The inside surface of the annular or cuff-shaped retaining member is suitably inclined to the retaining wedge. The clamping wedges may be guided in grooves formed in the inside surface of the retaining member. On that side which faces the mast the clamping wedges may carry clamping jaws having the shape of a segment of a cylinder.

In accordance with a further feature of the invention the clamping element consists of a ring, which is wedge-shaped in cross-section. The cuff-shaped retaining member and the annular clamping element may be provided with recesses so that the device can be clamped against the mast with the mast pocket interposed.

The tightening device may consist of a two-armed lever or of a tightening device including a toggle joint or an eccentric.

In accordance with a further feature of the invention an extension lever which is capable of a limited pivotal movement opposite to the tightening direction may be connected to the tightening lever, and the starting rope may be secured to the free end of said extension lever. That lever which constitutes an extension of the tightening lever virtually provides means for pulling the formed boom so that the mast can be more easily pulled out of the water. Such means for pulling on the forked boom has been described in the prior Patent Application P 31 17 312.8.

Figure 2:
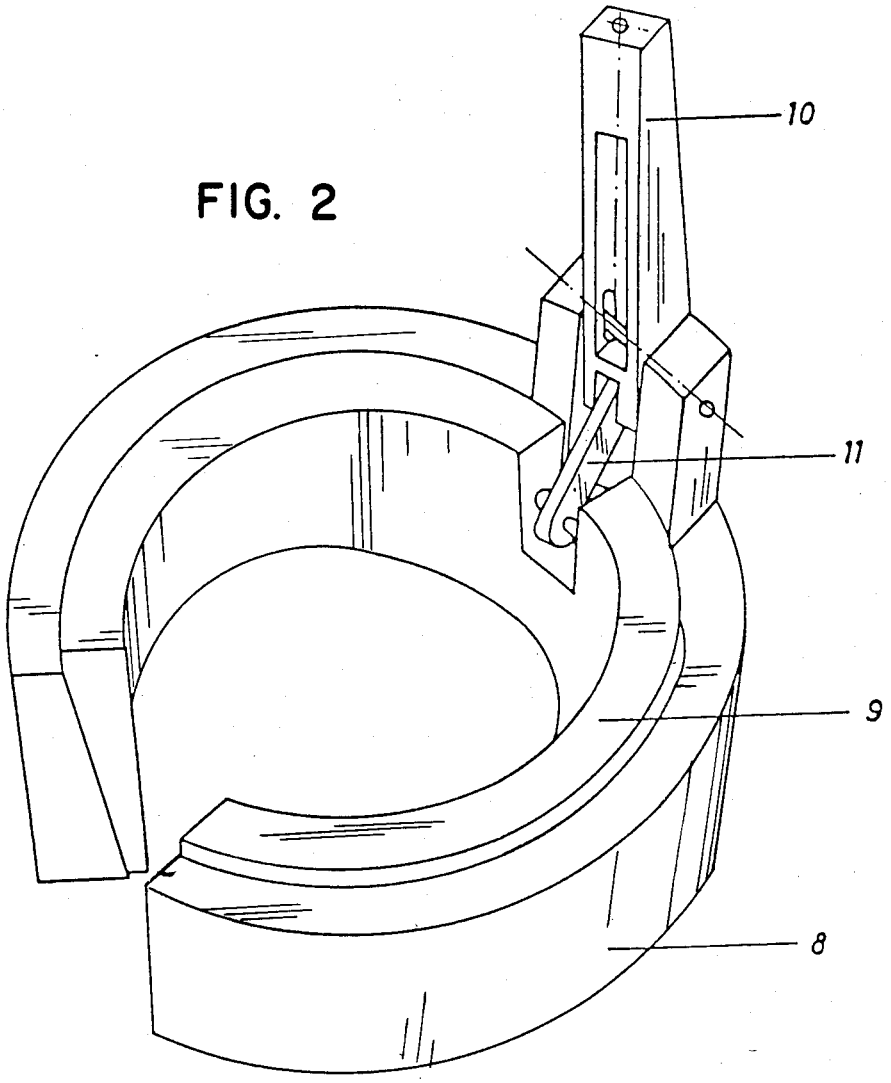
Figure 3:
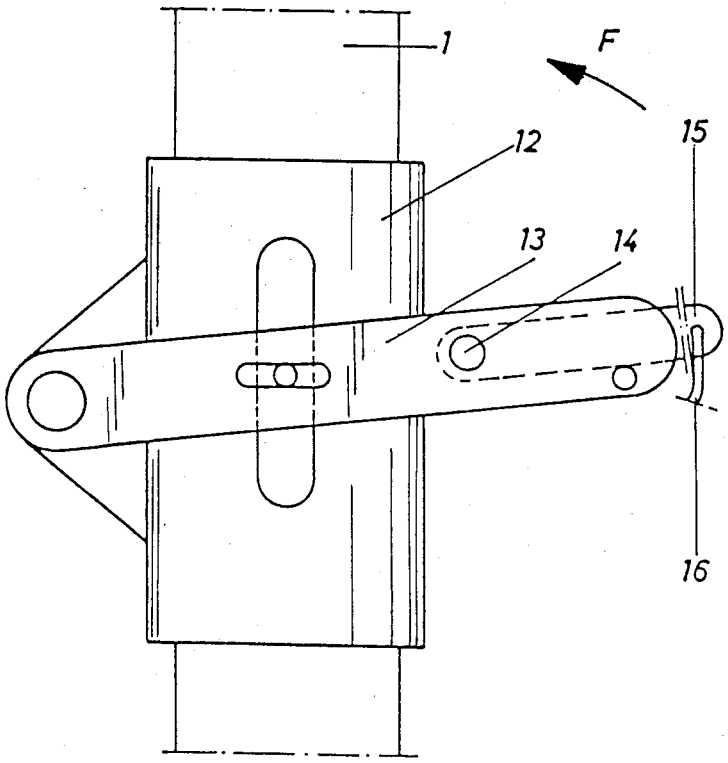
Figure 4:
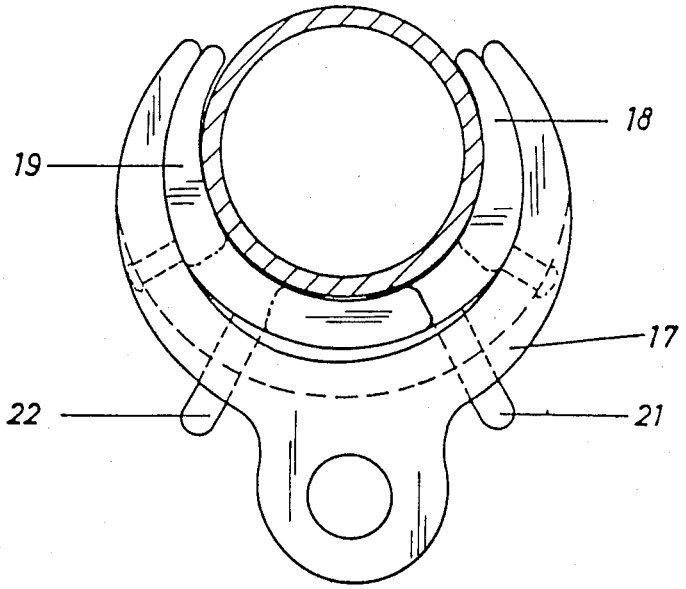
Figure 5:
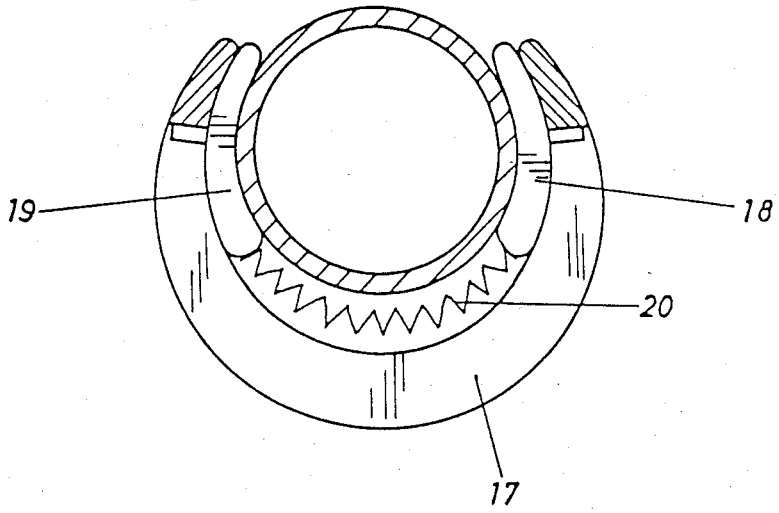

In accordance with a further feature of the invention, curved clamping wedges which are slidable in the peripheral direction are held in the annular gap. If said clamping wedges are disposed on opposite sides of the center plante which is defined by the taut sail, the clamping force will be increased by the tension exerted on the forked boom. The annular wedges may be guided in grooves of the retaining member. The retaining wedges may be spring-loaded toward the ends of the retaining members. For a displacement of the retaining members to the open position, the retaining wedges are provided with cams, which extend through the cufflike retaining member. Illustrative embodiments of the invention will now be explained in more detail with reference to the drawings, in which FIG. 1 is a perspective view showing a retaining cuff, which is adapted to be applied around the mast, and clamping wedges, which are guided in said cuff and are interconnected and can be forced against each other by a double-pivot lever, FIG. 2 is a perspective view showing a tightening device consisting of split conical bushings, FIG. 3 is a side elevation showing a securing device which comprises a tightening lever and an extension lever which is pivoted to the tightening lever, FIG. 4 is a top plan view showing cufflike retaining member and clamping elements consisting of annular wedges, and FIG. 5 is a horizontal sectional view showing the device of FIG. 4. The clamping device shown in FIG. 1 comprises an annular supporting cuff 2, which is adapted to be slidably fitted on the mast 1 in an axial or a radial direction and is formed with a sectorlike axially extending opening. The supporting cuff 2 is formed on mutually opposite sides of its inside surface with grooves, which have bottom surfaces that are beveled in wedge shape in the axial direction of the mast. Wedge-shaped clamping elements 3, 4, which are oppositely inclined, are guided in said grooves and on their confronting sides carry clamping jaws 5, 6, which have the shape of a segment of a cylinder and are clamped against the mast 1. To apply the clamping force, the clamping wedges 3, 4 are adapted to be displaced relative to the supporting cuff 2 in the axial direction of the mast 1 by a double-pivot lever 7. The double-pivot lever 7 embraces the mast 1 like a fork, and its legs are pivoted by means of pivot pins on luglike extensions 8 of the supporting cuff 2. The free ends of the legs of the double-pivot lever 7 are pivoted to the clamping wedges in the manner shown in FIG. 1.

The tightening device shown in FIG. 2 consists of two conical bushings, which are slidable one in the other and are provided with a sectorlike, axially extending opening. The outer conical bushing 8 constitutes a cuff, which supports the inner conical bushing 9. The two conical bushings 8, 9 are supported on each other by mutually oppositely inclined conical surfaces.

A tightening lever 10 for forcing the two conical bushings 8, 9 against each other is pivoted on the supporting cuff 8 and is pivoted to a tightening lever 11, which is pivoted to the inner bushing 9.

FIG. 3 shows a supporting cuff 12 and a tightening lever 13, which is pivoted to the cuff 12 and to which an extension lever 15 is pivoted by the pivot pin 14. In the tightened condition the extension lever 15 can be swung against the mast 1 in the direction of the arrow F. The starting rope 16 is secured to the end of the lever 15.

The embodiment shown in FIGS. 4 and 5 also comprises an annular supporting cuff 17, which is provided with an axially extending opening and in which annular wedges 18, 19 are guided, which are slidable in the peripheral direction. The annular wedges 18, 19 may be displaced in the clamping direction by special tightening devices or by a tightening spring 20. To permit a release of the clamped joint, the annular wedges 18, 19 are provided with cams 21, 22, which extend through slots in the supporting cuff.

We claim:

1. A device for securing a forked boom to a mast, said device comprising: an annular retaining member having a diameter larger than the mast diameter and adapted to be connected to the forked boom and positioned around the mast, and at least one wedge-shaped clamping element slidably mounted in an annular space between the retaining member and the mast for sliding movement relative to and along the inner surface of the retaining member and relative to and along the outer surface of the mast.

2. A device according to claim 1, wherein at least one wedge-shaped clamping element is axially slidable relative to the mast.

3. A device according to claim 1, wherein the at least one clamping element includes two clamping wedges to engage mutually opposite sides of the mast.

4. A device according to claim 1, wherein the retaining member includes mutually oppositely inclined interior surfaces and the clamping wedges bear on the inclined surfaces.

5. A device according to claim 1, wherein the interior surface of the retaining member includes grooves and the clamping wedges are guided for movement in the grooves of the retaining member.

6. A device according to claim 3, wherein the clamping wedges include clamping jaws having the shape of segments of a cylinder, the clamping jaws carried by the clamping wedges on that side thereof which faces the mast.

7. A device according to claim 1, wherein the at least one clamping element includes a ring which is wedge-shaped in cross-section.

8. A device according to claim 1, wherein the annular retaining member includes an axially extending opening having a transverse width sufficient to permit the mast to pass therethrough.

9. A device according to claim 7, wherein the annular retaining member and the annular clamping element each include axially extending openings having a transverse width sufficient to permit the mast to pass therethrough.

10. A device according to claim 1, including tightening means for moving the at least one clamping element relative to the retaining member to engage the mast.

11. A device according to claim 1, including a tightening lever pivotally carried by the retaining member and engageable with the at least one clamping element for moving the clamping element relative to the retaining member, and an extension lever capable of a limited pivotal movement opposite to the tightening direction and pivoted to the tightening lever, and a starting rope secured to said extension lever.

12. A device according to claim 1, wherein the at least one clamping element includes curved clamping wedges slidable in the peripheral direction of the mast, each of the curved clamping wedges being held in the annular gap.

13. A device according to claim 12, wherein the retaining member includes inner grooves and the curved wedges are guided for movement in the grooves of the retaining member.

14. A device according to claim 12, wherein the retaining member includes an annular cuff, which is formed with an axially extending opening having a transverse width sufficient to permit the mast to pass therethrough.

15. A device according to claim 12, wherein the curved wedges are spring-biased for movement toward each other along the inner surface of the retaining member for engagement with the mast.

16. A device according to claim 12, wherein the curved wedges include cams which extend through transverse openings in the retaining member to permit release of the wedges from a clamping position to an unclamping position.

17. A device according to claim 10, wherein the tightening means includes a toggle joint.

18. A device according to claim 10, wherein the tightening means includes a tightening lever pivotally carried by the retaining member and pivotally connected to the at least one clamping element.

* * * * *